United States Patent [19]

Tammen

[11] 3,967,326

[45] July 6, 1976

[54] FLANGE ASSEMBLY FOR INSTALLING A TOILET FIXTURE

[76] Inventor: Johnny Lee Tammen, 420 Cauley Lane, San Angelo, Tex. 76901

[22] Filed: Mar. 3, 1975

[21] Appl. No.: 554,591

[52] U.S. Cl. ..... 4/252 R; 4/68; 285/58

[51] Int. Cl.[2] ..... E03D 11/00

[58] Field of Search ..... 4/252 R, 68, 170; 285/58, 59, 60

[56] References Cited

UNITED STATES PATENTS

| | | | |
|---|---|---|---|
| 3,263,244 | 8/1966 | Katz | 4/252 R |
| 3,311,391 | 3/1967 | Harrell | 4/252 R X |
| 3,349,412 | 10/1967 | Schwartz et al. | 4/252 R |
| 3,568,222 | 3/1971 | Gantzert | 4/252 R |
| 3,579,670 | 5/1971 | Frank | 4/252 R |
| 3,732,582 | 5/1973 | Mielbeck et al. | 4/252 R |

*Primary Examiner*—Henry K. Artis
*Attorney, Agent, or Firm*—Marcus L. Bates

[57] ABSTRACT

A flange assembly for installing a toilet fixture comprised of a packer device having an upper mounting surface which receives the fixture in fixed relation thereto. A packer assembly underlies the mounting surface and enables the apparatus to be set about the marginal end of a soil pipe received through a concrete floor. Means are provided by which the packer device is easily expanded into engagement with the concrete floor and the soil pipe, leaving the upper mounting surface disposed at floor level.

10 Claims, 6 Drawing Figures

FLANGE ASSEMBLY FOR INSTALLING A TOILET FIXTURE

BACKGROUND OF THE INVENTION

The mounting of toilet fixtures for handling sanitary waste generally requires special skills and tools in order to adequately install the fixture to the terminal end of the outlet or soil pipe. The soil pipe is usually installed while the building is being erected, with the end thereof being arranged as conveniently as possible so that sanitary water closets, including urinals, floor drains, and the like, may be suitably connected thereto by placing the outlets thereof in axially aligned and sealed relationship respective to the upwardly opening terminal end of the soil pipe.

It is desirable that a sealed coupling be formed between the soil pipe and the bathroom fixture, and that the coupling be absolutely perfect so that reasonable sanitary conditions can be maintained above the floor level.

The proper installation of a coupling between the bathroom fixture and the soil pipe requires a skilled artesian with special tools. It is to be expected that over a long period of time, normal useage coupled with normal deteriation necessitates replacement of the coupling means.

Accordingly, it is desirable that installation of the coupling member require a minimum amount of time, thereby eliminating costly labor charges. More importantly, it is desirable that the coupling member cooperate with the floor, soil pipe and bathroom fixture so that each is suitably affixed to the other.

It is also desirable that such a coupling member form a positive seal between the interior of the soil pipe, the soil beneath the floor area, and the upper living area. It is also desirable that any potential leakage of sanitary waste into the living area or into the soil beneath the floor area be completely eliminated.

Furthermore, it is desirable that installation of such a coupling require no special talents other than a labor using a simple wrench; and further, that a simiflexible connection be effected between the soil pipe and the floor by the coupling.

DESCRIPTION OF THE PRIOR ART

| | | | |
|---|---|---|---|
| Currier | 3,421,551 | Karlinski | 2,908,513 |
| Robinson | 2,837,750 | LeTarte | 2,082,348 |

In the above cited prior art, Robinson provides an inner surface or ring which must be plugged with plastic or putty, while a groove thereof must be caulked by filling with molten lead.

LeTarte discloses a toilet fixture for use in conjunction with a water closet of special design, so that when the closet is removed from the fixture, part of the coupling is of necessity removed therewith. Karlinski is similar to LeTarte and fails to provide suitable sealing means between the supporting surface 5 and the soil pipe. Currier is similar to the LeTarte and Robinson disclosure.

None of the art cited above discloses a mounting flange assembly which rigidly supports a bathroom fixture from a concrete floor while resiliently tying the soil pipe to the concrete floor in sealed relation to the fixture sanitary waste outlet.

SUMMARY OF THE INVENTION

The present invention discloses a flange assembly which resiliently attaches a marginal end portion of a soil pipe to a floor so that a toilet fixture can be affixed to the flange assembly in a manner which precludes leakage of sanitary waste therefrom.

In particular, the flange assembly comprises a horizontally disposed flange from which there downwardly depends a cylindrical skirt member. A resilient gasket is interposed between the downwardly opening skirt member and a compression ring, with the flange, skirt member, resilient gasket, and compression ring being superimposed upon one another in axially aligned relationship.

A tension bolt moves the compression ring toward the cylindrical skirt, thereby radially expanding the resilient gasket, causing it to be outwardly deformed into engagement with the supporting surface, and inwardly deformed into engagement with a marginal outer peripheral wall surface of an end portion of the soil pipe.

The toilet fixture is bolted onto the upper face of the flange in sealed relation therewith so that sanitary waste is directed from the fixture directly into the soil pipe, thereby avoiding contamination of the area above and below floor level.

Therefore, a primary object of the invention is to provide improvements in a mounting flange assembly for toilet fixtures.

Another object of the invention is to provide improvements in mounting flange assemblies which enables a toilet fixture to be rapidly connected to a soil pipe in supported relation respective to a floor.

A further object of this invention is to disclose and provide a mounting flange assembly which resiliently affixes a soil pipe to a concrete floor so that a toilet fixture can be mounted in an affixed relationship to the soil pipe, the floor, and the flange.

A still further object of this invention is to provide a mounting flange assembly for connecting a toilet fixture to a soil pipe in a new and unobvious manner.

Another and still further object is to provide a mounting flange assembly for mounting and connecting a toilet fixture to a soil pipe received through a floor in a simple and economical manner.

These and various other objects and advantages of the invention will become readily apparent to those skilled in the art upon reading the following detailed description and claims and by referring to the accompanying drawings.

Throughout the remainder of this specification, like numerals generally refer to like or similar parts.

The above objects are attained in accordance with the present invention by the provision of an apparatus fabricated in a manner substantially as described in the above abstract and summary.

DESCRIPTION OF THE PREFERRED EMBODIMENTS

Figure 1:
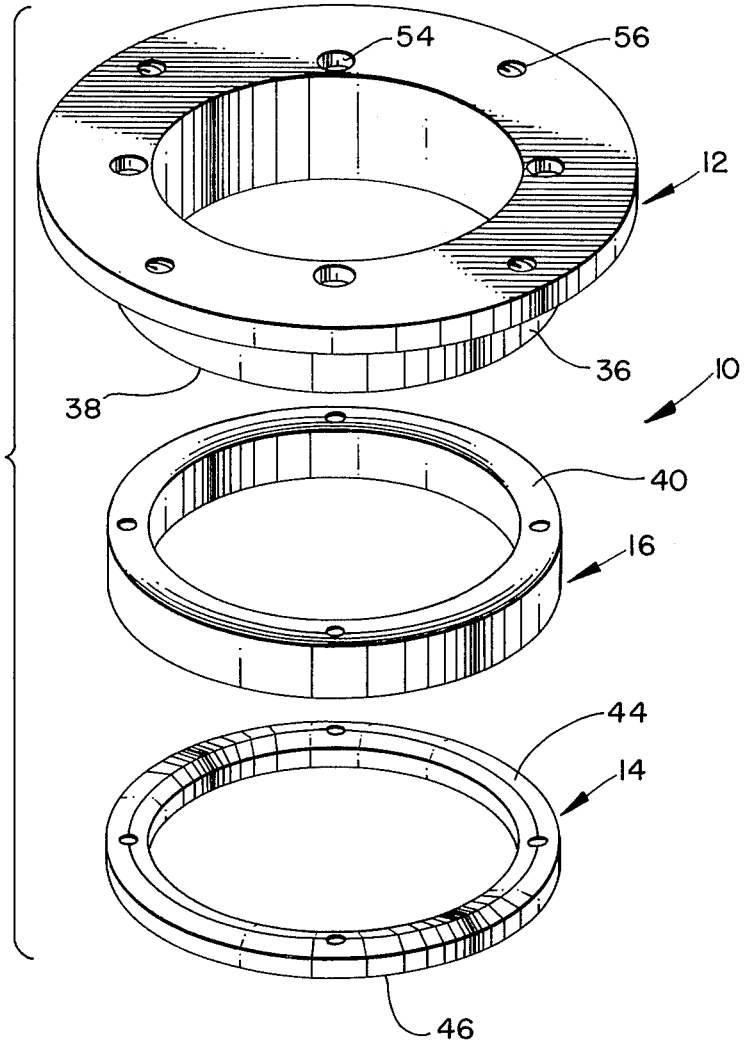
FIG. 1 is an exploded perspective view which discloses a mounting flange assembly made in accordance with the present invention.

FIG. 1 discloses a mounting flange assembly 10 made in accordance with the present invention. The assembly comprises a compression flange 12, a compression ring 14 spaced from and axially aligned with the compression flange, and a resilient neoprene gasket 16 interposed between the compression flange and compression ring.

Figure 2:
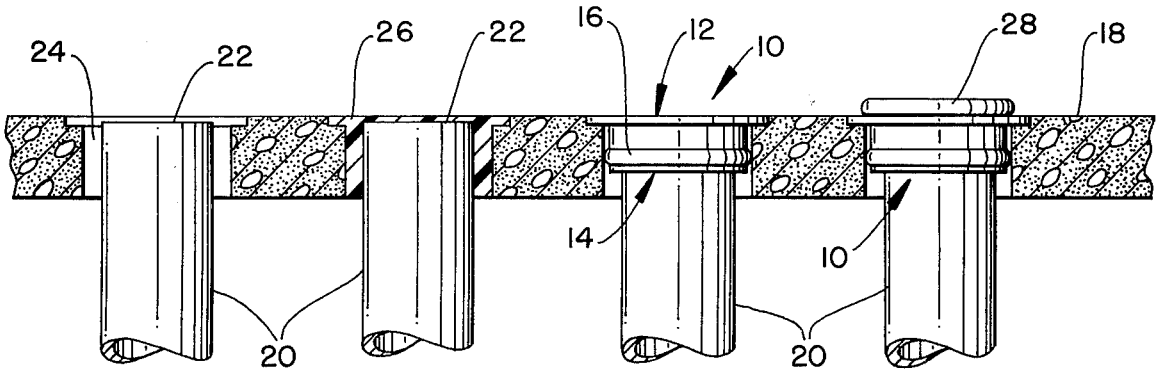
FIG. 2 is a reduced, broken, part cross-sectional representation disclosing one method of using the present invention.

In FIG. 2 a supporting surface, specifically a concrete floor 18, receives an upstanding soil pipe 20 therethrough. The upper terminal end of the soil pipe usually terminates slightly recessed respective to the upper surface of the floor. Generally, the floor is apertured in a manner so that at least the upper marginal end of the soil pipe is spaced from the wall of the concrete, thereby leaving an annular area or void 24 between the concrete floor and the outer surface of the soil pipe.

The annulus formed between the pipe and floor preferably is formed by a void forming foam plastic insert 26, arranged in the illustrated configuration of FIG. 2. The annulus formed in this manner more precisely cooperates with the assembled flange apparatus made in accordance with the present invention.

Numeral 28 discloses a conventional wax ring which is compressed between a toilet fixture and the mounting flange when the fixture is permanently attached thereto.

Figure 3:
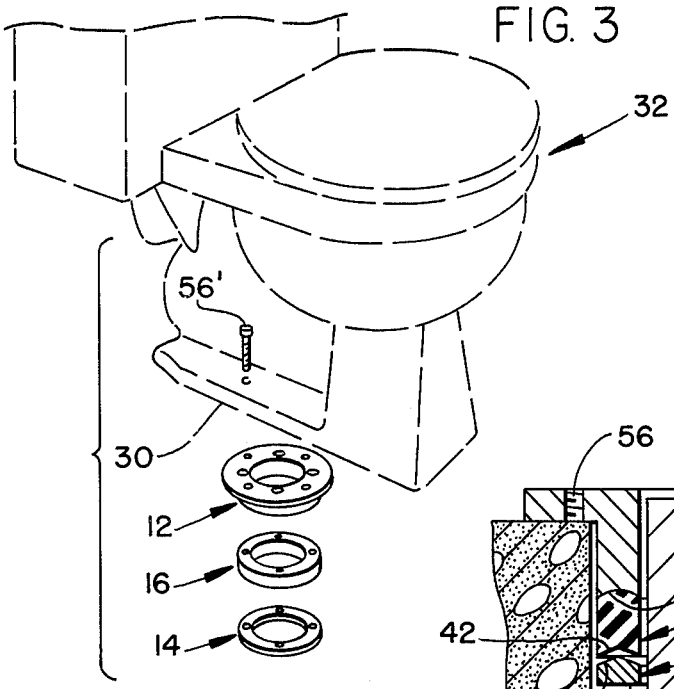
FIG. 3 is a reduced, fragmentary, part phantom, disassembled view of the present invention operatively associated with a toilet fixture.

In FIG. 3 there is disclosed a sanitary water closet 32 having a base 30 arranged to bear against a supporting surface such as the before mentioned concrete floor.

Figure 4:
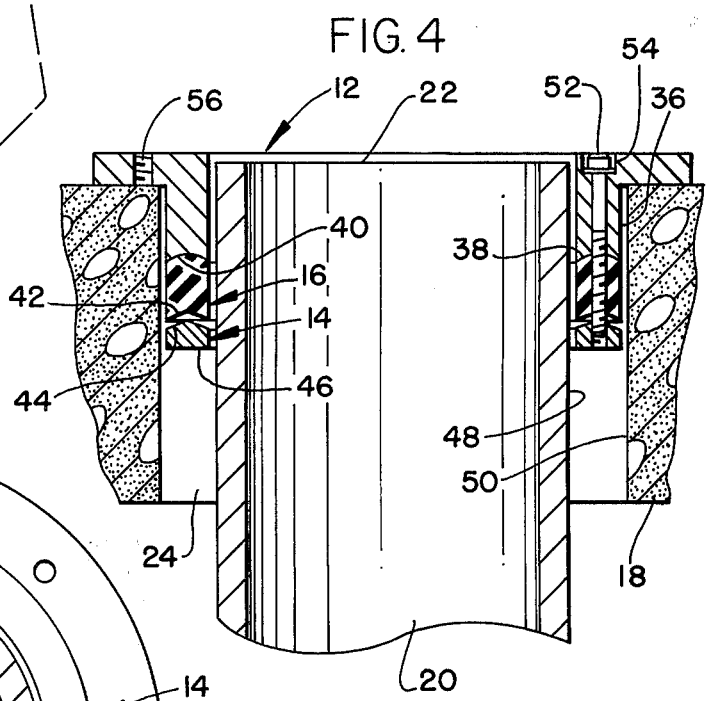
FIG. 4 is a fragmentary, part cross-sectional view taken along line 4—4 of FIG. 5.
Figure 5:
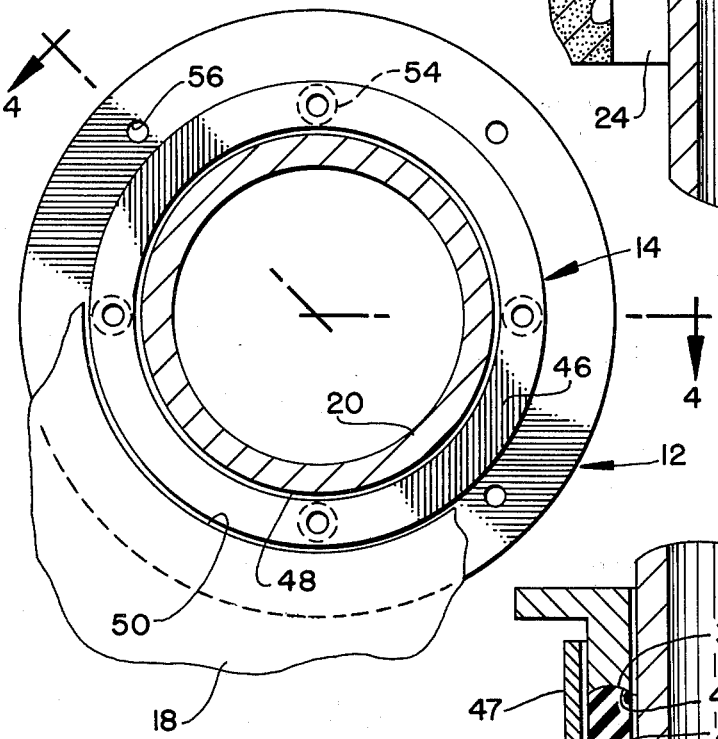
FIG. 5 is a fragmentary, part cross-sectional top plan view of FIG. 4.

Looking now to FIGS. 4 and 5, in conjunction with other figures of the drawings, the compression flange is provided with the illustrated upper and lower opposed faces, with a downwardly depending circumferentially extending cylindrical skirt member 36 being attached to the lower face thereof, and having a circumferentially extending lower edge portion 38 disposed horizontally to the upper flange face.

The resilient gasket has an upper face 40 which is brought into engagement with the circumferentially extending concave lowermost edge portion 38 of the skirt member. Lower face 42 of the gasket is brought into engagement with the upper convex face 44 of the annular compression ring. The compression ring is provided with a lower face 46 spaced from face 44.

As best seen in FIG. 4, the outer peripheral surface area of a marginal end portion 48 of the soil pipe is spaced from an inner circumferentially extending surface area 50 of the concrete support surface 18, thereby leaving the before mentioned annular area 24 therebetween. The before mentioned resilient gasket is sized so that it can be forced into engagement with the spaced vertical walls forming the annular area 24 to thereby firmly but resiliently secure the soil pipe and the mounting flange to the concrete floor.

Radially spaced apart tension bolts 52 are received through radially spaced vertical bores 54, which extend in axial aligned relation through the flange, skirt, resilient gasket, and into the compression ring so that tightening of the tension bolt forces the compression ring toward the skirt member.

Spaced threaded fastening means 56 provide a simple means by which the bathroom fixture can be readilly attached to the upper face of the flange by utilizing the existing apertures found in the base 30, thereby rigidly securing the fixture to the conrete floor in sealed relationship respective to the soil pipe.

Figure 6:
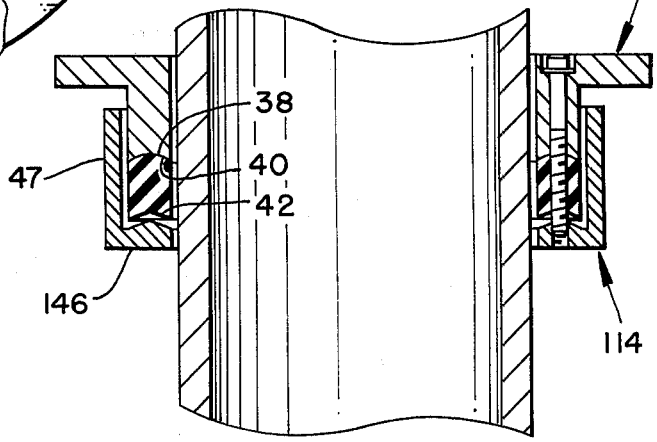
FIG. 6 is a fragmentary, part cross-sectional view of another embodiment of the present invention.

In FIG. 6 the compression ring 114 is provided with an upwardly depending skirt member 47 concentrically arranged in overlapping and telescoping relationship respective to skirt member 36 of the flange.

The outwardly disposed flange 12 of FIG. 6 can be disposed at an angle respective to the illustrated pipe, if desired, so that the apparatus can be used on either a flat or sloped roof for the purpose of running a vent line therethrough with the roof being arranged in underlying relationship respective to the outwardly directed flange.

In operation, the tension bolts preferably are provided with an "allen head" so that a common "allen wrench" can be included in a package comprised of two fastener means 56' by which a bathroom fixture is attached to threaded aperture 56, four tension bolts 52, the compression flange, a resilient neoprene gasket, a compression ring, and a void forming plastic insert 26.

During formation of a concrete floor 18, the foamed plastic insert 26 is placed about the marginal end portion of the soil pipe so that an annulus is formed therebetween.

After the structure associated with the concrete floor has been completed, an unskilled workman can easily install the fixture by substituting the assembled mounting flange assembly for the void forming insert and tightening the tension bolts with the provided allen wrench. The tension bolts are made up sufficiently tight to cause deformation of the resilient neoprene gasket, thereby forcing the deformed gasket into sealing engagement with the spaced vertical walls forming the annular area between the soil pipe and the concrete floor.

With the lower face of the flange suitably seated on the upper supporting surface of the concrete, the usual wax ring is next properly positioned in superimposed axially aligned relationship respective to the soil pipe, the bathroom fixture is positioned thereabove, and thereafter fastened to the compression flange by two or more of the radially spaced threaded fastener means, thereby completing the installation of the invention.

I claim:

1. In a toilet fixture supported by a support surface in overlying relationship respective to a soil pipe which has a free marginal end portion extending through the support surface to leave an annulus between the soil pipe and the support surface, so that the toilet fixture is arranged in spaced axially aligned relationship respective to a sanitary waste discharge from the fixture, the improvement comprising:

a mounting flange assembly by which the fixture is attached to the support surface and soil pipe; said mounting flange assembly comprising a horizontally disposed flange having a minor and major diameter and opposed upper and lower faces, a downwardly depending cylindrical skirt affixed to said minor diameter of said flange and arranged normally to the lower face thereof; a terminal free end of said skirt forming a face which is disposed parallel to said upper face;

a resilient gasket, a compression ring; said skirt, gasket and ring being concentrically aligned along a common axis with said gasket being interposed between said ring and said terminal free end of said skirt;

apertures formed through said flange, skirt, gasket, and ring to form a bolt receiving passageway which is radially spaced from and parallel to the axial centerline of said skirt; a tension bolt received through said apertures;

fastener means by which the toilet fixture is affixed to the mounting flange assembly;

means by which tension can be placed on said bolts to force said resilient gasket into engagement with said skirt and said ring, to cause radial expansion of said resilient gasket so that it completely fills a marginal length of said annulus and thereby releasably affixes the toilet fixture, soil pipe, horizontally disposed flange, and support surface to one another.

2. The mounting flange assembly of claim 1 wherein said compression ring is cylindrical in form and is further provided with an upper convex surface for engagement with, and expansion of, said resilient gasket.

3. The mounting flange assembly of claim 1 wherein the lower free depending end of said cylindrical skirt is concave for engagement with, and expansion of, said resilient gasket.

4. The mounting flange assembly of claim 1 and further including means by which threaded apertures are formed in said flange for receiving a fastener means therein so that a fixture can be removably attached thereto.

5. The mounting flange assembly of claim 1 and further including a void forming insert by which an annulus is formed between the marginal end of the soil pipe and the supporting surface, said surface being a concrete floor.

6. The mounting flange assembly of claim 1 wherein said compression ring is cylindrical and is provided with an upper convex surface for engagement with, and expansion of, said resilient gasket;

means by which the lower free depending end of said cylindrical skirt is made concave in form for engagement with, and expansion of, said resilient gasket;

and further including threaded apertures formed in said flange for receiving a fastener means therein so that a fixture can be attached thereto.

7. The mounting flange assembly of claim 1 wherein said compression ring further includes an upstanding cylindrical skirt member concentrically arranged for receiving said first recited skirt member in a telescoping manner therewithin so that said flange assembly can be used for a roof vent.

8. In a bathroom fixture which is releasably affixed to the marginal end of a soil pipe, wherein the soil pipe extends through the concrete floor with an annulus being formed between the pipe and floor, in combination; a flange assembly for supporting the fixture respective to the floor and pipe;

said flange assembly having a circumferentially extending compression flange member to which there is integrally attached a downwardly depending cylindrical skirt member, said skirt member having a lower circumferentially extending terminal end portion spaced from and underlying the flange;

a resilient gasket, cylindrical in form, which can be radially expanded when compressed along its axial centerline;

a compression ring, cylindrical in form;

said skirt, gasket and ring having substantially equal inner and outer diameters and being axially aligned and concentrically arranged respective to one another;

means forming a plurality of radially spaced apertures, spaced from one another, and formed through said flange, skirt, gasket and compression ring in axially aligned relationship;

a plurality of tension bolts, each received through one of said apertures, means on said tension bolts by which they can be manipulated to cause said flange to move toward said ring so that when said gasket is interposed between said ring and said skirt, the gasket will be expanded radially inwardly and outwardly so that it will contact and be compressed against a marginal length of the wall surface of both the floor and skirt which forms the annulus, to thereby affix the flange assembly to both the floor and the soil pipe;

and means by which the bathroom fixture can be mounted to the flange of the assembly.

9. The assembly of claim 8 wherein there is additionally provided a void forming plastic insert by which said assembly can be properly fitted respective to a concrete floor and a soil pipe.

10. The assembly of claim 8 wherein said compression ring is provided with an upwardly depending skirt member which circumferentially extends about an outer edge portion of said ring member and is concentrically arranged respective to said downwardly depending cylindrical skirt member;

one said skirt member being telescopingly received within the other.

* * * * *